US010502043B2

(12) United States Patent
Gajic

(10) Patent No.: US 10,502,043 B2
(45) Date of Patent: Dec. 10, 2019

(54) METHODS AND DEVICES TO PERFORM OFFSET SURVEYS

(71) Applicant: Nabors Drilling Technologies USA, Inc., Houston, TX (US)

(72) Inventor: Bosko Gajic, Kingwood, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 215 days.

(21) Appl. No.: 15/659,777

(22) Filed: Jul. 26, 2017

(65) Prior Publication Data

US 2019/0032468 A1 Jan. 31, 2019

(51) Int. Cl.

| | |
|---|---|
| ***E21B 47/00*** | (2012.01) |
| ***E21B 7/00*** | (2006.01) |
| ***E21B 19/16*** | (2006.01) |
| ***E21B 47/12*** | (2012.01) |
| ***E21B 47/18*** | (2012.01) |
| ***E21B 47/022*** | (2012.01) |
| ***E21B 19/00*** | (2006.01) |
| *E21B 47/06* | (2012.01) |
| *E21B 47/024* | (2006.01) |

(52) U.S. Cl.

CPC ..... *E21B 47/00* (2013.01); *E21B 19/00* (2013.01); *E21B 19/16* (2013.01); *E21B 47/02216* (2013.01); *E21B 47/122* (2013.01); *E21B 47/18* (2013.01); *E21B 47/0006* (2013.01); *E21B 47/024* (2013.01); *E21B 47/06* (2013.01); *E21B 47/065* (2013.01)

(58) Field of Classification Search

CPC ..... E21B 7/00; E21B 49/00; E21B 47/00

See application file for complete search history.

(56) References Cited

U.S. PATENT DOCUMENTS

| | | | | |
|---|---|---|---|---|
| 4,141,153 | A | 2/1979 | Nelson | |
| 4,329,647 | A | 5/1982 | Freedman | |
| 4,361,192 | A | 11/1982 | Trowsdale | |
| 4,380,264 | A | 4/1983 | Lyons et al. | |
| 4,399,692 | A | 8/1983 | Hulsing, II et al. | |
| 4,505,048 | A | 3/1985 | Sharp | |
| 5,467,290 | A | 11/1995 | Darland et al. | |
| 5,787,997 | A | 8/1998 | Hartmann | |
| 5,821,414 | A | 10/1998 | Noy et al. | |
| 6,633,816 | B2 | 10/2003 | Shirasaka et al. | |
| 7,085,696 | B2 * | 8/2006 | King | E21B 7/00 703/10 |
| 7,886,844 | B2 | 2/2011 | Phillips | |
| 8,011,447 | B2 | 9/2011 | Keniston et al. | |
| 8,016,036 | B2 * | 9/2011 | Kirkwood | E21B 47/122 166/255.1 |

(Continued)

*Primary Examiner* — Kenneth L Thompson

(74) *Attorney, Agent, or Firm* — Haynes and Boone, LLP

(57) ABSTRACT

Systems, devices, and methods for performing surveys are provided. A first set of surveys may be performed during a drilling operation on a drilling rig. A tubular may be removed from a drill string, and a second set of surveys may be performed during a tripping out operation on the drilling rig, such that the first set of surveys is offset from the second set of surveys. A tubular may be added to the drill string, and a third set of surveys may be performed during a tripping in operation on the drilling rig, such that the third set of surveys is offset from the first set of surveys and the second set of surveys.

20 Claims, 8 Drawing Sheets

(56) References Cited

U.S. PATENT DOCUMENTS

| | | | | |
|---|---|---|---|---|
| 8,305,230 | B2 | 11/2012 | Westin et al. | |
| 8,594,937 | B2 | 11/2013 | Mann et al. | |
| 8,596,385 | B2 | 12/2013 | Benson et al. | |
| 9,003,862 | B2 | 4/2015 | Rodney et al. | |
| 9,074,455 | B2 * | 7/2015 | Pilgrim | E21B 21/01 |
| 9,146,330 | B2 | 9/2015 | Djikpesse et al. | |
| 9,297,249 | B2 | 3/2016 | McElhinney et al. | |
| 9,347,308 | B2 | 5/2016 | Benson et al. | |
| 9,970,266 | B2 * | 5/2018 | Marx | E21B 44/00 |
| 2013/0098685 | A1 * | 4/2013 | Collares | E21B 7/00 175/40 |

* cited by examiner

METHODS AND DEVICES TO PERFORM OFFSET SURVEYS

TECHNICAL FIELD

The present disclosure is directed to systems, devices, and methods for taking offset surveys of a wellbore. More specifically, the present disclosure is directed to systems, devices, and methods for taking offset surveys with a downhole Measurement While Drilling (MWD) device during drilling and tripping operations on a drilling rig.

BACKGROUND OF THE DISCLOSURE

Drilling rigs may conduct operations that include performing downhole surveys to determine the location of the wellbore as well as the location and position of a bottom hole assembly (BHA). Surveys are typically taken by downhole MWD tools under static conditions. In particular, surveys may be taken while making new drilling connections, such as during the period when stands are connected or disconnected on the drilling rig. A drawback to this process is that it that taking a survey is time consuming and can generally only be done at certain times during a drilling operation. For example, operations on the drilling rig must be stopped long enough for the survey tool to reach a static condition and take the survey, followed by the time needed to turn on mud pumps and the time required to put the BHA in contact with the bottom of the wellbore and stabilize at the desired drilling parameters of the drilling operation. This can result in a large amount of unproductive time, and generally results in surveys only being taken once per drilling connection (unless there is a special requirement). Therefore, a need exists for methods and devices to more efficiently take surveys without incurring additional nonproductive drilling time.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
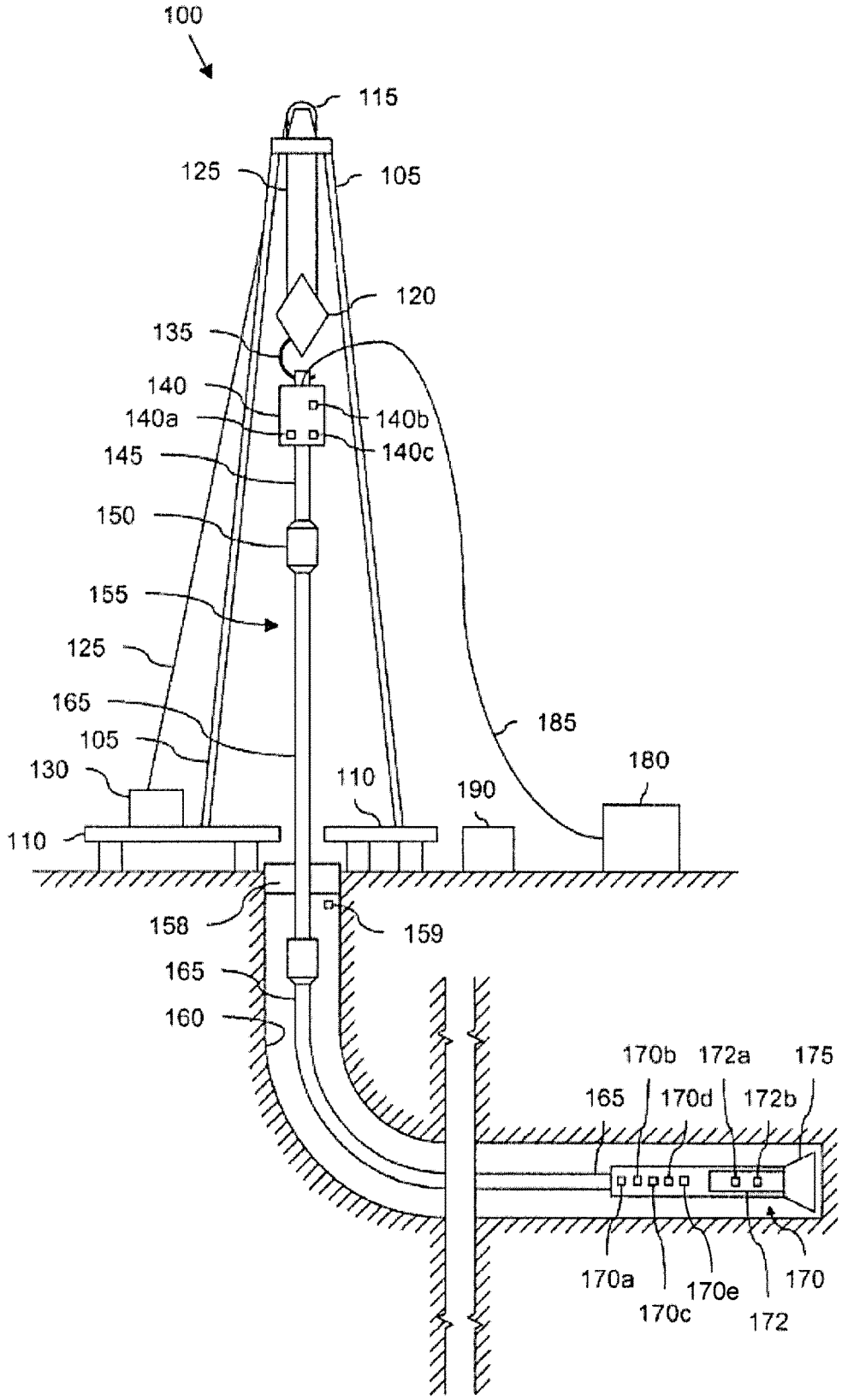
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods disclosed herein provide for taking offset surveys in a wellbore. In particular, the present disclosure describes methods and systems to take surveys during tripping in and tripping out operations in addition to surveys taken during drilling operations with the surveys being offset and therefore being usable to provide additional directional data. In some implementations, a single tubular is removed before a tripping in operation which may allow for surveys offset from the surveys of the drilling operation. In other implementations, a single tubular may be added to the drill string before a tripping in operation which may allow for further surveys offset from the previous surveys. The additional survey information may allow for better accuracy in assessing the location of a wellbore and/or the position of a BHA in a subterranean formation. This information in turn may help in drilling future holes and may provide more accurate information enabling better decisions on the drilling rig. Furthermore, offset survey information combined with conventional survey information may be more accurate than conventional surveys alone, which may improve drilling accuracy and may enable smaller ellipses of uncertainty along the length of the wellbore. In some implementations, the survey results are displayed on a display device for viewing by an operator. The results may be displayed together such that all survey locations may be viewed.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 may include interconnected sections of drill pipe 165, a bottom hole assembly (BHA) 170, and a drill bit 175. In some implementations, the drill string 155 includes stands of interconnected sections of drill pipe 165. These stands may include two, three, four, or other numbers of sections of drill pipe 165. The sections of drill pipe 165 may be attached together by being threaded together. The drill string 155 may be assembled before, during, and after operations on the drilling rig. For example, the drill string 155 may have stands added to it during a drilling operation as well as tripping in operations, while stands are removed from the drill string 155 during tripping out operations. The stands may be independently assembled (for example at the surface) and added or removed one at a time from the drill string 155.

The BHA 170 may include stabilizers, drill collars, and/or MWD or wireline conveyed instruments, among other components. In some implementations, the BHA 170 includes a MWD survey tool. As will be discussed below, the MWD survey tool may be configured to perform surveys along the length of the wellbore and transmit this information to a controller for analysis.

For the purpose of slide drilling, the drill string may include a down hole motor with a bent housing or other bent component, operable to create an off-center departure of the bit from the center line of the wellbore. The direction of this departure in a plane normal to the wellbore is referred to as the toolface angle or toolface. The drill bit 175 may be connected to the bottom of the BHA 170 or otherwise attached to the drill string 155. One or more pumps 180 may deliver drilling fluid to the drill string 155 through a hose or other conduit, which may be connected to the top drive 140. In some implementations, the one or more pumps 180 include a mud pump.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic waves, among other methods. In some implementations, survey data, including any of the evaluations of physical properties as discussed above, is transmitted regularly to the controller throughout the various operations of the drilling rig. For example, during a drilling operation, a survey instrument may transmit survey data from a most recent survey as soon as it is performed. The MWD sensors or detectors and/or other portions of the BHA 170 may have the ability to store measurements for later retrieval via wireline and/or when the BHA 170 is tripped out of the wellbore 160. In some implementations, the BHA 170 includes a memory for storing these measurements.

In an exemplary implementation, the apparatus 100 may also include a rotating blow-out preventer (BOP) 158 that may assist when the wellbore 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190. The controller 190 may include at least a processor, a memory, and a communication device. The memory may include a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some implementations, the memory may include a non-transitory computer-readable medium. The memory may store instructions. The instructions may include instructions that, when executed by the processor, cause the processor to perform operations described herein with reference to the controller 190 in connection with implementations of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor of the controller 190 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the controller 190 as shown in FIG. 1 above. The processor may also be implemented as a combination of computing devices, e.g., a combination of a DSP and a microprocessor, a plurality of microprocessors, one or more microprocessors in conjunction with a DSP core, or any other such configuration. The processor may access the memory and execute instruction in the memory.

The controller 190 may be configured to control or assist in the control of one or more components of the apparatus 100. For example, the controller 190 may be configured to transmit operational control signals to the drawworks 130, the top drive 140, the BHA 170 and/or the one or more pumps 180. In some implementations, the controller 190 may be a stand-alone component. The controller 190 may be disposed in any location on the apparatus 100. Depending on the implementation, the controller 190 may be installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. In other implementations, the controller 190 is disposed remotely from the drilling rig. The controller 190 may be configured to transmit the operational control signals to the drawworks 130, the top drive 140, the BHA 170, and/or the one or more pumps 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. For example, the controller 190 may include a data acquisition module for receiving readings from the various sensors on the drilling rig. For example, the controller 190 may receive and store signals from the MWD survey tool 170*e*. The controller 190 may also be configured to manipulate and display data, such as on a display device.

Depending on the implementation, the apparatus 100 may include a down hole annular pressure sensor 170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a* may include both static annular pressure (pumps off) and active annular pressure (pumps on).

Figure 2:
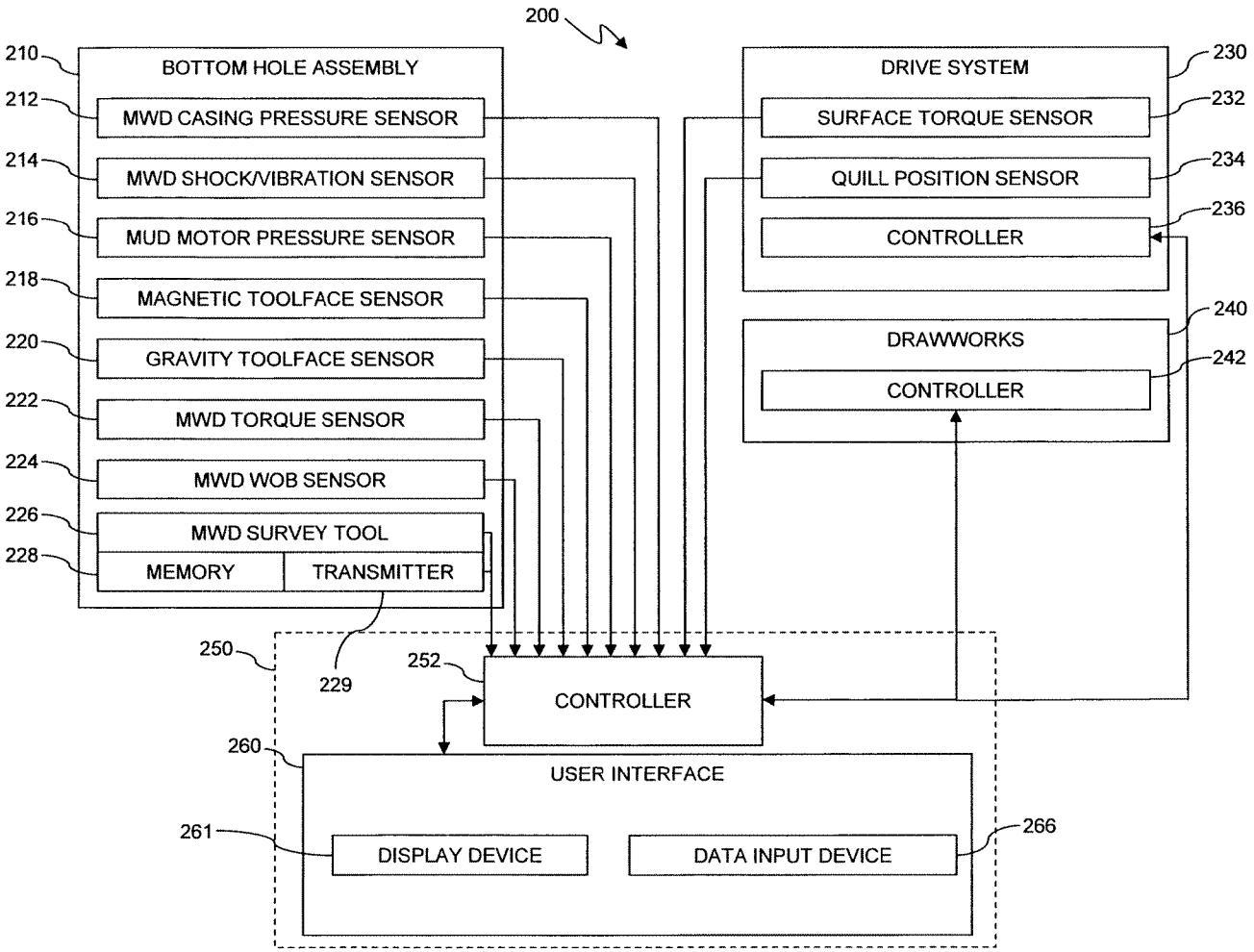
FIG. 2 is a schematic of an exemplary sensor and control system according to one or more aspects of the present disclosure.

The controller 190 may also be configured to communicate prompts, status information, sensor readings, survey results, and other information to an operator, for example, on a user interface such as user interface 260 of FIG. 2. The controller 190 may communicate via wired or wireless communication channels.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172. In some implementations, the shock/vibration sensor 170*b* may be used to determine when the drill string 155 is at rest and a survey may be performed. For example, the shock/vibration sensor 170*b* may determine that the drill string 155 is at rest when there is no motion because the system is stopped while a new stand is being added to the drill string 155. At this time, a survey may be automatically performed to take advantage of the period of inactivity on the drilling rig.

The apparatus 100 may additionally or alternatively include a toolface sensor 170*c* configured to detect the current toolface orientation. In some implementations, the toolface sensor 170*c* may be or include a conventional or future-developed magnetic toolface sensor which detects toolface orientation relative to magnetic north. Alternatively or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170.

The apparatus 100 may additionally or alternatively include a MWD survey tool 170*e* at or near the BHA 170. In some implementations, the MWD survey tool 170*e* includes any of the sensors 170*a*-170*d* as well as combinations of these sensors. The MWD survey tool 170*e* may be configured to perform surveys along length of a wellbore, such as during drilling and tripping operations. The data from these surveys may be transmitted by the MWD survey tool 170*e* to the controller 190 through various telemetry methods, such as electromagnetic (EM) waves or mud pulses. Additionally or alternatively, the data from the surveys may be stored within the MWD survey tool 170*e* or an associated memory. In this case, the survey data may be downloaded to a controller 190 when the MWD survey tool 170*e* is removed from the wellbore or at a maintenance facility at a later time. In wired systems, the MWD survey tool 170*e* may communicate at any point with the controller 190, including during drilling or other operations.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that may be based on active and static hook load) (e.g., one or more sensors installed somewhere in the load path mechanisms to detect and calculate WOB, which may vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

Referring to FIG. 2, illustrated is a block diagram of a sensor and control system 200 according to one or more aspects of the present disclosure. The sensor and control system 200 includes a user interface 260, a bottom hole assembly (BHA) 210, a drive system 230, a drawworks 240, and a controller 252. The sensor and control system 200 may also include a Measurement While Drilling (MWD) survey tool 226. The sensor and control system 200 may be implemented within the environment and/or apparatus shown in FIG. 1. For example, the BHA 210 may be substantially similar to the BHA 170 shown in FIG. 1, the drive system 230 may be substantially similar to the top drive 140 shown in FIG. 1, the drawworks 240 may be substantially similar to the drawworks 130 shown in FIG. 1, the controller 252 may be substantially similar to the controller 190 shown in FIG. 1, and the MWD survey tool 226 may be substantially similar to the MWD survey tool 170*e* shown in FIG. 1.

The user interface 260 and the controller 252 may be discrete components that are interconnected via wired or wireless devices. Alternatively, the user interface 260 and the controller 252 may be integral components of a single system or controller 252, as indicated by the dashed lines in FIG. 2.

The user interface 260 may include a data input device 266 for user input of one or more toolface set points, and other information. The user interface 260 may also include devices or methods for data input of other set points, limits, and other input data. The data input device 266 may also be used to manipulate and view data received by the controller 252. In some implementations, the data input device 266 is connected to the display device 261 and may be used to select and display data thereon. The data input device 266 may include a keypad, voice-recognition apparatus, dial, button, switch, slide selector, toggle, joystick, mouse, data base and/or other conventional or future-developed data input device. The data input device 266 may support data input from local and/or remote locations. Alternatively, or additionally, the data input device 266 may include devices for user-selection of predetermined toolface set point values or ranges, such as via one or more drop-down menus. The toolface set point data may also or alternatively be selected by the controller 252 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a display device 261 arranged to present data, status information, sensor results, prompts, measurements and calculations, drilling rig visualizations, as well as any other information. The user interface 260 may visually present information to the user in visual form, such as textual, graphic, video, or other form, or may present information to the user in audio or other sensory form. In some implementations, the display device 261 is a computer monitor, an LCD or LED display, table, touch screen, or other display device. The user interface 260 may include one or more selectable icons or buttons to allow an operator to access information and control various systems of the drilling rig. In some implementations, the display device 261 is configured to present information related to survey results on the drilling rig. In particular, the display device 261 may be configured to display the results of offset surveys simultaneously, such as displaying the results of surveys performed during a drilling operation, performed during a tripping out operation, and performed during a tripping in operation on the same display. The survey results as well as other measurement data may be displayed graphically on the display device 261, such as on a chart or by using various colors, patterns, symbols, images, figures, or patterns.

In some implementations, the sensor and control system 200 may include a number of sensors. Although a specific number of sensors are shown in FIG. 2, the sensor and control system 200 may include more or fewer sensors than those disclosed. Furthermore, some implementations of the drilling system may include additional sensors not specifically described herein.

Still with reference to FIG. 2, the BHA 210 may include an MWD casing pressure sensor 212 that is configured to detect an annular pressure value or range at or near the MWD portion of the BHA 210, and that may be substantially similar to the down hole annular pressure sensor 170*a* shown in FIG. 1. The casing pressure data detected via the MWD casing pressure sensor 212 may be sent via electronic signal to the controller 252 via wired or wireless transmission.

The BHA 210 may also include an MWD shock/vibration sensor 214 that is configured to detect shock and/or vibration in the MWD portion of the BHA 210, and that may be substantially similar to the shock/vibration sensor 170*b* shown in FIG. 1. The shock/vibration data detected via the MWD shock/vibration sensor 214 may be sent via electronic signal to the controller 252 via wired or wireless transmission.

The BHA 210 may also include a mud motor pressure sensor 216 that is configured to detect a pressure differential value or range across the mud motor of the BHA 210, and that may be substantially similar to the mud motor pressure sensor 172*a* shown in FIG. 1. The pressure differential data detected via the mud motor pressure sensor 216 may be sent via electronic signal to the controller 252 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the controller 252 via wired or wireless transmission.

The BHA 210 may also include a MWD torque sensor 222 that is configured to detect a value or range of values for torque applied to the bit by the motor(s) of the BHA 210, and that may be substantially similar to the torque sensor 172*b* shown in FIG. 1. The torque data detected via the MWD torque sensor 222 may be sent via electronic signal to the controller 252 via wired or wireless transmission.

The BHA 210 may also include a MWD WOB sensor 224 that is configured to detect a value or range of values for WOB at or near the BHA 210, and that may be substantially similar to the WOB sensor 170*d* shown in FIG. 1. The WOB data detected via the MWD WOB sensor 224 may be sent via electronic signal to the controller 252 via wired or wireless transmission.

The BHA 210 may also include a MWD survey tool 226. The MWD survey tool 226 may be similar to the MWD survey tool 170*e* of FIG. 1. The MWD survey tool 226 may be configured to perform surveys at intervals along the wellbore, such as during drilling and tripping operations. The data from these surveys may be transmitted by the MWD survey tool 226 to the controller 242 through various telemetry methods, such as electromagnetic (EM) waves or mud pulses. In other implementations, survey data is collected and stored by the MWD survey tool in an associated memory 228. This data may be uploaded to the controller at a later time, such as when the MWD survey tool is removed from the wellbore or during maintenance. In some implementations, the MWD survey tool 226 may be used to perform offset surveys for higher precision in estimating the location of a wellbore and/or the position of a BHA 210, as discussed below.

The BHA 210 may include a memory 228 and a transmitter 229. In some implementations, the memory 228 and transmitter 229 are integral parts of the MWD survey tool, while in other implementations, the memory 228 and transmitter 229 are separate and distinct modules. The memory 228 may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory 228 may be configured to store readings and measurements for some period of time. In some implementations, the memory 228 is configured to store the results of surveys performed by the MWD survey tool 226 for some period of time, such as the time between drilling connections, or until the memory 228 may be downloaded after a tripping out operation.

The transmitter 229 may be any type of device to transmit data from the BHA 210 to the controller 252, and may include an EM transmitter and/or a mud pulse transmitter. In some implementations, the MWD survey tool 226 is configured to transmit survey results in real-time to the surface through the transmitter 229. In other implementations, the MWD survey tool 226 is configured to store survey results in the memory 228 for a period of time, access the survey results from the memory 228, and transmit the results to the controller 252 through the transmitter 229.

The drawworks 240 may include a controller 242 and/or other devices for controlling feed-out and/or feed-in of a drilling line (such as the drilling line 125 shown in FIG. 1). Such control may include rotational control of the drawworks (in versus out) to control the height or position of the hook, and may also include control of the rate the hook ascends or descends.

The drive system 230 may be the same as the top drive 140 in FIG. 1 and may include a surface torque sensor 232 that is configured to detect a value or range of the reactive torsion of the quill or drill string, much the same as the torque sensor 140*a* shown in FIG. 1. The drive system 230 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 252 via wired or wireless transmission. The drive system 230 also includes a controller 236 and/or other devices for controlling the rotational position, speed, and direction of the quill or other drill string component coupled to the drive system 230 (such as the quill 145 shown in FIG. 1).

The controller 252 may be configured to receive information or data relating to one or more of the above-described parameters from the user interface 260, the BHA 210 (including the MWD survey tool 226), the drawworks 240, and/or the drive system 230. In some implementations, the parameters are transmitted to the controller 252 by one or more data channels. In some implementations, each data channel may carry data or information relating to a particular sensor.

In some implementations, the controller 252 may also be configured to determine a current toolface orientation. The controller 252 may be further configured to generate a control signal, such as via intelligent adaptive control, and provide the control signal to the drive system 230 and/or the drawworks 240 to adjust and/or maintain the toolface orientation.

The controller 252 may also provide one or more signals to the drive system 230 and/or the drawworks 240 to increase or decrease WOB and/or quill position, such as may be required to accurately "steer" the drilling operation.

Figure 3:
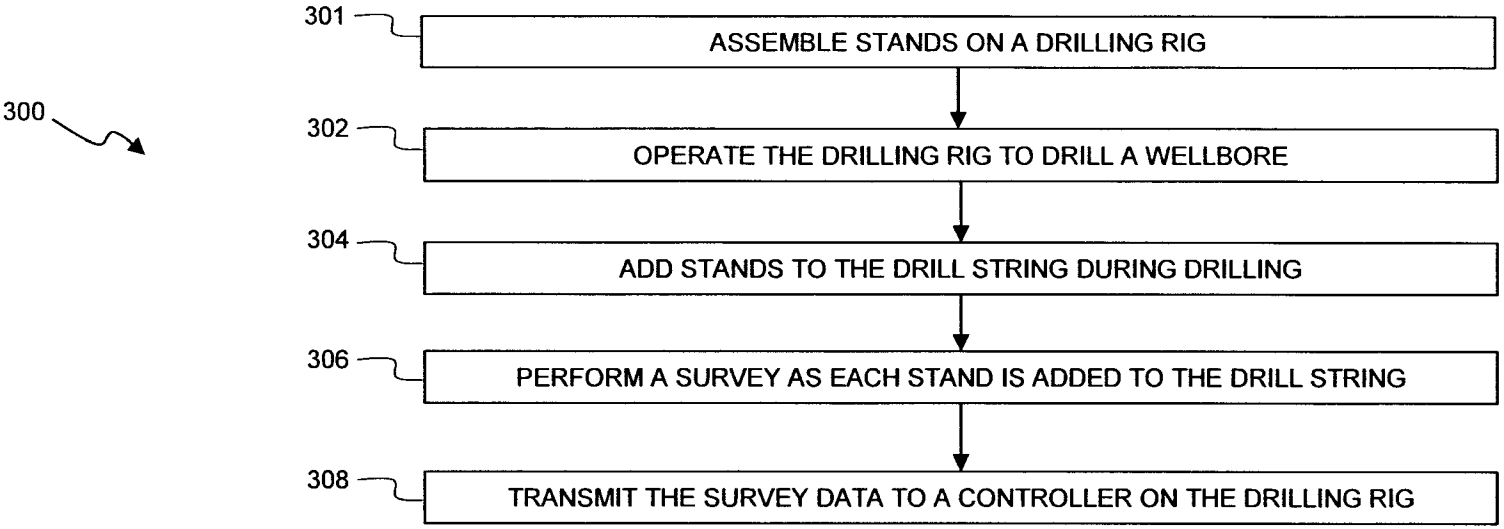
FIG. 3 is a flow chart diagram of a method of performing surveys during a drilling operation according to one or more aspects of the present disclosure.
Figure 5:
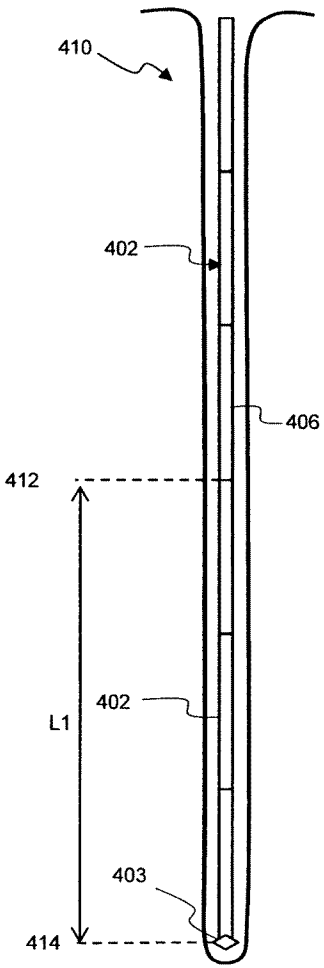
FIG. 5 is a diagram of a drill string during a drilling operation according to one or more aspects of the present disclosure.
Figure 6:
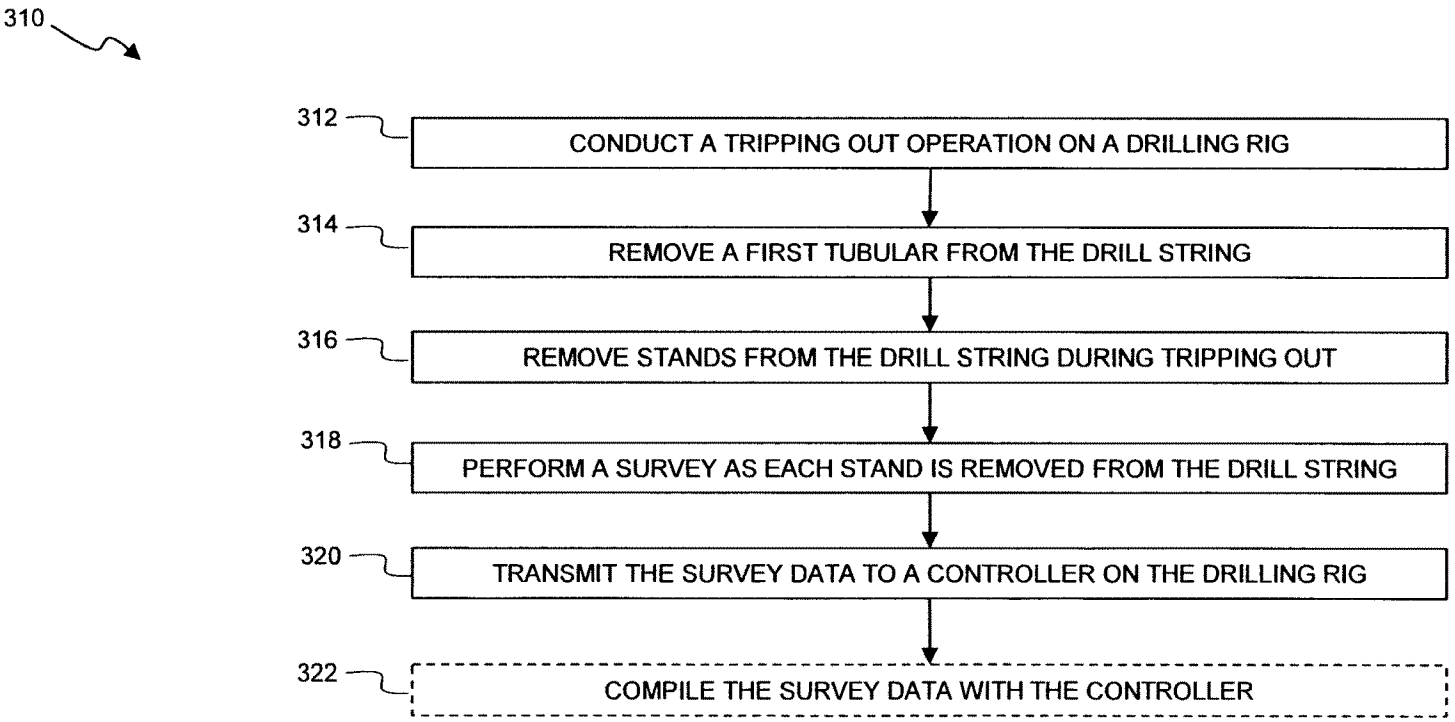
FIG. 6 is a flow chart diagram of a method of performing surveys during a tripping out operation according to one or more aspects of the present disclosure.
Figure 7B:
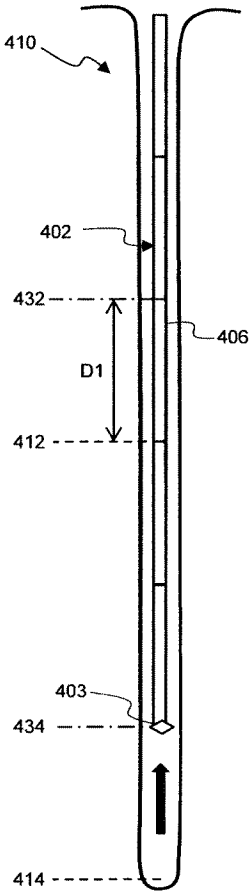
FIG. 7B is a diagram of a drill string at a second time during a tripping out operation according to one or more aspects of the present disclosure.
Figure 7A:
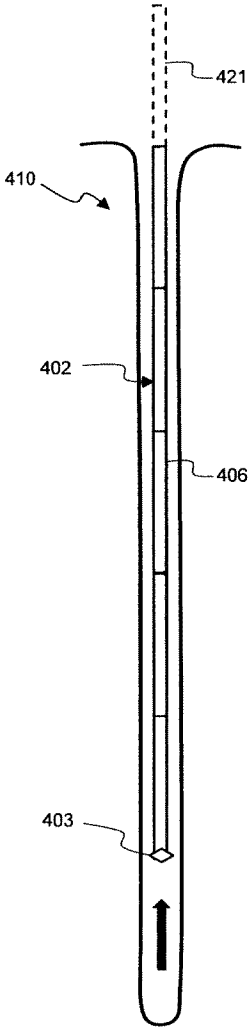
FIG. 7A is a diagram of a drill string at a first time during at a tripping out operation according to one or more aspects of the present disclosure.
Figure 8:
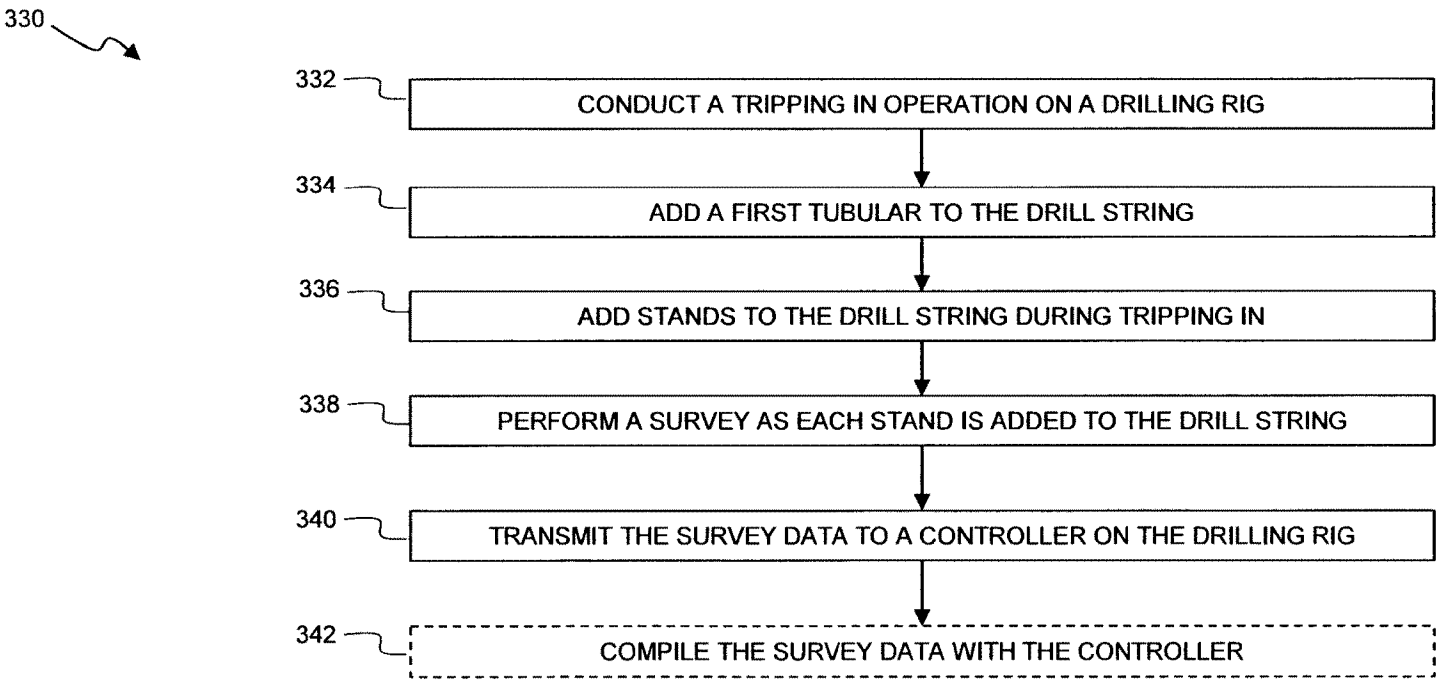
FIG. 8 is a flow chart diagram of a method of performing surveys during a tripping in operation according to one or more aspects of the present disclosure.

FIGS. 3, 6, and 8 are flow charts showing methods 300, 310, 330 of performing surveys on a drilling rig. In some implementations, the steps of two or all of the methods 300, 310, 330 may be performed together to produce offset surveys of a wellbore. For example, the methods 300, 310, and 330 may be performed in succession to produce offset surveys along the length of a wellbore. FIGS. 4, 5, 7A-7B, and 9A-9C illustrate aspects of the systems associated with methods 300, 310, and 330.

FIG. 3 is a flow chart showing a method 300 of performing surveys during a drilling operation. It is understood that additional steps may be provided before, during, and after the steps of method 300, and that some of the steps described may be replaced or eliminated for other implementations of the method 300. In particular, any of the control systems disclosed herein, including those of FIGS. 1 and 2 may be used to carry out the method 300.

Figure 4:
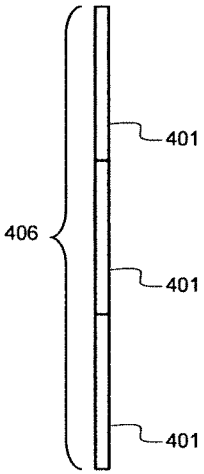
FIG. 4 is a diagram of a drill stand according to one or more aspects of the present disclosure.

At step 301, the method 300 may include assembling stands on a drilling rig. In some embodiments, stands may be assembled by joining two or more tubulars together such as by threading the tubulars together. FIG. 4 shows an exemplary drill stand 406 that includes three tubulars 401 which have been threaded together. In other implementations, a stand 406 may include two, three, four, or more tubulars 401 connected together. The length of the individual tubulars 401 may be approximately 20 feet, 30 feet, 45 feet, or other lengths. In some implementations, the lengths of tubulars 401 are within a range of about 30 feet to 36 feet. In other implementations, the lengths of tubulars 401 are within a range of about 40 feet to 45 feet. The length of each stand 406, therefore, may be about 60 feet to 68 feet, about 90 to 108 feet, or other lengths depending on the length of the tubulars 401 and the number of tubulars 401 making up the stand 406. In an exemplary implementation shown in FIG. 4, the stand 406 is in a range of about 90 feet to 108 feet long and includes three tubulars 401 with a length in a range of about 30 feet to 36 feet each. However, in other implementations, stands 406 may comprise more or fewer tubulars 401. For example, a stand 406 may include two tubulars 401 with a length of about 40 to 45 feet for a total stand length of 90 to 108 feet.

At step 302, the method 300 may include operating a drilling rig to drill a wellbore. The drilling rig may be the apparatus 100 of FIG. 1. The drilling rig may be operated by a directional driller to drive a BHA attached to a drill string to produce a wellbore. FIG. 5 shows an exemplary view of a drill string 402 including a number of stands 406 with an attached BHA 403 that has been used to produce a wellbore 410. Each stand includes a number of tubulars 401 that are attached together. Accordingly, FIG. 5 shows a wellbore 410 with two stands 406 comprising the drill string 402. Naturally, the drill string 402 may comprise tens or hundreds of stands.

At step 304, the method 300 may include adding stands to the drill string during the drilling operation. This may include pausing the drilling by stopping the rotary, such as the top drive and turning off the pumps. The crew may set the slips to grip and temporarily hang the drill string. The top drive may be unscrewed from a threaded connection on the drill string, and may be raised to accommodate a new stand of pipe. The top drive may then be screwed into the new stand of pipe. The bottom of the stand may then be screwed into the top of the temporarily hanging drill string. The driller may then raise the top drive to pick up the entire drill string to remove the slips, and then may carefully lower the drill string while starting the pumps and top drive. The drill string may resume drilling when the BHA touches bottom of the wellbore 410.

At step 306, the method 300 may include performing a survey as each stand is added to the drill string. Since drilling may be paused as each stand is added to the drilling rig, vibrations from drilling equipment are minimized during these periods of time. This in turn may allow a high precision survey to be performed. Since the addition of each stand may include turning off mud pumps, disconnecting the top drive, placing the drill string on slips, and attaching the new stand, the survey may be taken while the drill string is relatively stationary. In addition, the surveys may be performed at regular intervals since the stands are added to the drill string at regular intervals. For example, when using stands having a length of 90 feet, a survey may be performed at intervals of about 90 feet along the wellbore. When using stands with a length of about 90-135 feet, surveys may be performed at intervals of about 90-135 feet. In other implementations, surveys are performed at different intervals depending on the lengths of the stands. In some implementations, a MWD survey tool (such as any of MWD survey tool 226 or 170*e* as shown in FIGS. 1 and 2) may include a vibration sensor and may be configured to automatically perform a survey when vibrations drop below a certain level. This may ensure that the survey is as accurate as possible, and that adequate time is available to perform the survey. Survey results may be stored in a memory associated with the MWD survey tool. In the example of FIG. 5, surveys are performed at locations 412 and 414 along the wellbore that are approximately the length L1 of a stand 406 apart. When length L1 is 90 feet, the interval between locations 412 and 414 is about 90 feet. Other intervals are possible. For example, a drill string may be used with a stand length of about 60 feet. In this case, the interval between survey locations is likewise about 60 feet. More surveys may be performed along the length of the wellbore, with each survey location corresponding to the addition of a stand 406 to the drill string 402.

At step 308, the method 300 may include transmitting the survey data to a controller on the drilling rig. In some implementations, the survey data may be transmitted to a data acquisition device on a controller, such as either of the controllers 190 or 252 shown in FIGS. 1 and 2. In some implementations, the survey results are stored in the MWD survey tool or in other memory downhole until the BHA is removed from the wellbore and then the stored information may be downloaded to the controller. In other implementations, the survey results are transmitted to a controller on the surface such as through EM waves, mud pulses, and/or through wired pipes.

FIG. 6 is a flow chart showing a method 310 of performing surveys during a tripping out operation. It is understood that additional steps may be provided before, during, and after the steps of method 310, and that some of the steps described may be replaced or eliminated for other implementations of the method 310. In particular, any of the control systems disclosed herein, including those of FIGS. 1 and 2 may be used to carry out the method 310.

At step 312, the method 310 may include conducting a tripping out operation on a drilling rig. In some implementation, this operation involves the removal of the drill string from the wellbore. This may include turning off the pumps and raising the top drive with the drill string attached to the top drive. When the top drive is at a sufficient height, the crew may set the slips to grip and temporarily hang the drill string. Tripping out may be performed periodically between drilling operations to change drilling equipment.

At step 314, the method 310 may include removing a first tubular or a portion, but not all, of a stand from the drill string. In some implementations, the method includes removing one tubular from a stand making up the drill string. In other implementation, the method includes removing two tubulars from a stand making up the drill string. Other numbers of tubulars may be removed so long as the complete stand is not being removed. FIGS. 7A and 7B illustrate the removal of tubular 421 from the drill string 402 as a first step in the tripping out operation before other stands are removed and the tripping out operation proceeds. Removing a portion of the drill string (such as tubular 421 shown in FIG. 7A) before proceeding may allow offset surveys to be taken during the tripping out operation, as will be discussed below. Removing the tubular from the drill string may include raising the top drive until the tubular is out of the bore hole. After setting the slips to temporarily hang or suspend the drill string, the tubular may be removed from the rest of the stand and from the drill string. The top drive may be unscrewed from a threaded connection on the tubular, and the tubular may be placed in storage, either on or off of the drilling rig.

At step 316, the method 310 may include removing full-length stands from the drilling string during the tripping out operation. As discussed above, each stand may comprise a number of tubulars that are attached together. If the length of stands while drilling had been three tubulars, the length of stands removed at 316 is also three tubulars. The tripping out operation may include a pause at each stand in the drill string while the connections are broken down and the stand is removed from the drill string.

At step 318, the method 310 may include performing a survey as each stand is removed from the drill string during the period of time that the BHA is relatively stable within the wellbore. In some implementations, each survey is performed during the pause required to remove each stand, with the drill string held by slips, while the stand is removed from the top drive or the drill string. In some implementations, the positions at which the surveys are performed are spaced apart by approximately the length of a stand. In the example of FIG. 7B, surveys at locations 432 and 434 are performed during the tripping out operation. Because a single tubular was removed from the drill string before the tripping out operation, the surveys may be performed at a position offset from the original survey position. For example, the survey locations 432 and 434 (as shown in FIG. 7B) are offset from the survey locations 412 and 414 that were performed during the drilling operation by the length of a tubular, which was removed in the method at 314. In some implementations, the survey positions taken during the tripping out operation are offset by approximately the length of a tubular from the survey positions of the drilling operation. For example, if the tubular had a length of 30 feet, then the offset distance D1 as shown in FIG. 7B is approximately 30 feet. In other implementations, D1 may be the length of any tubular, including 20 feet, 45 feet, or other distances.

At step 320, the method 310 may include transmitting the survey data to a controller on the drilling rig. Similar to step 308 of method 300, the survey results may be stored before transmission or may be transmitted in real time to a controller on the surface. The survey results may be transmitted through a variety of ways, including through EM waves, mud pulses, wired pipes and/or wirelessly.

At step 322, the method 310 may optionally include compiling the survey data with the controller. In some implementations, the survey data associated with both the drilling operation and the tripping operation may be compiled. This compilation may allow for more precise measurements of the location of a wellbore, geologic formations, and/or the position of a BHA within a wellbore. In some implementations, this survey data may be displayed, such as on a display device 261.

FIG. 8 is a flow chart showing a method 330 of performing surveys during a tripping in operation. It is understood that additional steps may be provided before, during, and after the steps of method 330, and that some of the steps described may be replaced or eliminated for other implementations of the method 330. In particular, any of the control systems disclosed herein, including those of FIGS. 1 and 2 may be used to carry out the method 330.

At step 332, the method 330 may include conducting a tripping in operation on a drilling rig. In some implementation, this operation involves the insertion of the BHA and drill string back into the wellbore. Tripping in may be performed after a tripping out operation to reinsert the drill string before further drilling operations.

Figure 9C:
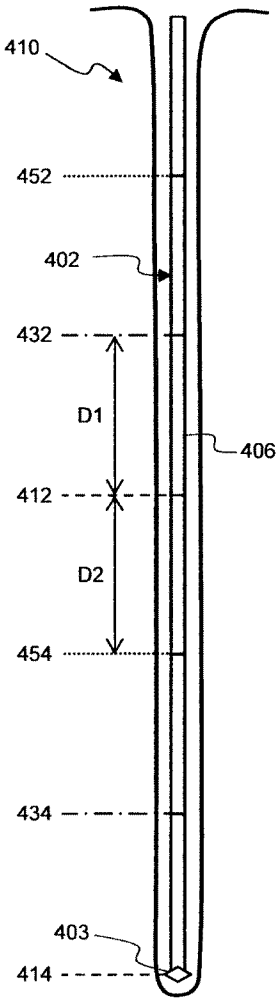
FIG. 9C is a diagram of a drill string at a third time during a tripping in operation according to one or more aspects of the present disclosure.
Figure 9B:
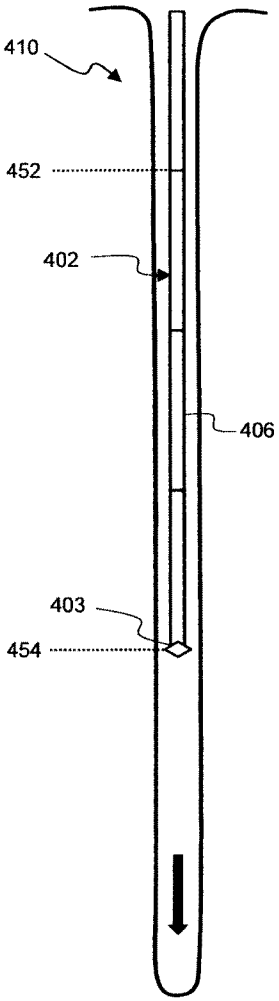
FIG. 9B is a diagram of a drill string at a second time during a tripping in operation according to one or more aspects of the present disclosure.
Figure 9A:
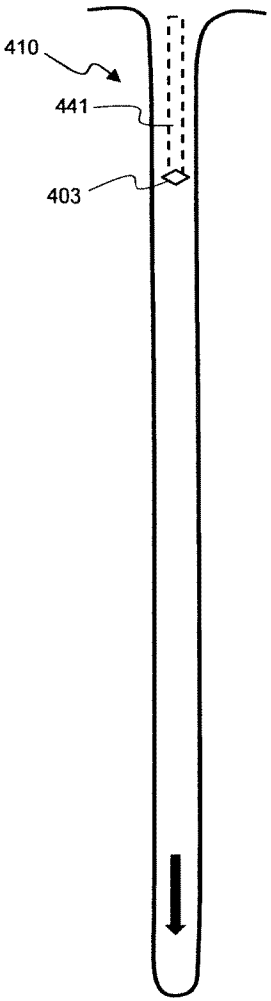
FIG. 9A is a diagram of a drill string at a first time during a tripping in operation according to one or more aspects of the present disclosure.

At step 334, the method 330 may include adding a first tubular or portion of a stand, but not a complete stand, to the drill string. The first tubular or portion of a stand may be added before any full stands are added to a drilling string. In other implementations, the first tubular is added to a stand already on the drill string. FIG. 9A illustrates the addition of tubular 441 to the drill string 402 before the tripping in operation proceeds. Adding the tubular before proceeding may allow offset surveys to be taken during the tripping in operation, as will be discussed below.

At step 336, the method 330 may include adding stands to the drill string during the tripping in operation. As discussed above, each stand may comprise two or three tubulars (or other numbers of tubulars) that are attached together. The tripping in operation may include a pause to add each stand from the drill string while the drill string is held stationary.

At step 338, the method 330 may include performing a survey as each stand is added to the drill string. In some implementations, each survey is performed during the pause required to add each stand. In some implementations, the positions at which the surveys are performed are spaced apart by approximately the length of a stand. A survey may be performed before the first stand is added to the drill string. In the example of FIG. 9B, surveys at locations 452 and 454 are performed during the tripping in operation. Because a single tubular was added from the drill string before the tripping in operation, the surveys may be performed at a position offset from the survey positions of the drilling operation and the tripping out operation. For example, FIG. 9C shows survey locations 452 and 454 that are offset from the survey locations 412 and 414 that were performed during the drilling operation and survey locations 432 and 434 that were performed during the tripping out operation. In some implementations, the survey positions of the tripping out operation are offset by approximately the length of a tubular from the survey positions of the drilling operation, and approximately the length of two tubulars from the survey positions of the tripping out operation. In the example of FIG. 9C, the offset distance D2 between the surveys of the drilling operation and the surveys of the tripping in operation is approximately 30 feet, although dependent on the length of the tubular. In other implementations, D2 is approximately 20 feet, 45 feet, or other distances.

At step 340, the method 330 may include transmitting the survey data to a controller on the drilling rig. Similarly to step 308 of method 300, the survey results may be stored before transmission or may be transmitted in real time to a controller on the surface. The survey results may be transmitted through a variety of ways, including through EM waves, mud pulses, wired pipes and/or wirelessly.

At step 342, the method 330 may optionally include compiling the survey data with the controller. In some implementations, the survey data associated with the drilling operation and the tripping operation may be compiled. This compilation may allow for more precise measurements of the location of a wellbore and/or the position of a BHA within a wellbore. In some implementations, this survey data may be displayed, such as on a display device 261. The display may include the offset survey positions as shown on FIG. 9C, such that all the survey data gathered from the drilling operation, the tripping out operation, and tripping in operation are displayed together. This data may allow for survey results along the length of a wellbore at a distance of approximate the length of a tubular.

In the example of FIG. 9C, the locations of the various offset surveys performed during drilling, tripping out, and tripping in are shown together. Surveys 412 and 414 were performed during drilling (also shown in FIG. 5) which are offset from surveys 432 and 434 which were performed during tripping out (also shown in FIG. 7B) which are offset from surveys 452 and 454 which were performed during tripping in (also shown in FIG. 9B). The aggregation of these various sets of survey data may provide for greater accuracy in determining the location of the wellbore and/or BHA within the wellbore which in turn may lead to better decisions by a driller.

In view of all of the above and the figures, one of ordinary skill in the art will readily recognize that the present disclosure introduces a method of performing surveys during a drilling operation on a drilling rig, including: forming a stand by joining a plurality of tubulars; performing a drilling operation that advances a drill string to form a wellbore through a subterranean formation, including: adding a plurality of stands to the drill string; and taking a downhole survey when a stand of the plurality of stands is added to the drill string to create a first set of surveys; performing a tripping out operation to remove a portion of the drill string from the wellbore, including: removing only a portion of a first stand from the drill string; removing full-length stands from the drill string during the tripping out operation; and taking a downhole survey when each stand of the plurality of stands is removed from the drill string to create a second set of surveys, such that the second set of surveys is offset from the first set of surveys.

In some implementations, the first and second sets of surveys are offset from each other by a distance approximately equivalent to a length of the portion of the first stand removed during the tripping out operation. The step of removing the portion of the first stand may include removing a tubular with a length in a range of about 30 to 36 feet. The step of removing a portion of the first stand may include removing a tubular with a length in a range of about 40 to 45 feet. The method may also include performing the first and second set of surveys with an electromagnetic Measurement While Drilling (MWD) tool.

The method may also include performing a tripping in operation to insert a portion of the drill string into the wellbore, including: adding a portion of a second stand to the drill string; adding full-length stands of the plurality of stands to the drill string during the tripping in operation; and taking a downhole survey when each stand of the plurality of stands is added to the drill string to create a third set of surveys, such that the first and second sets of surveys are offset from the third set of surveys. The method may also include displaying the first, second, and third sets of surveys on a display device.

The method may further include transmitting survey data corresponding to the first and second sets of surveys to a controller on the drilling rig. The method may include transmitting survey data corresponding to the first and second sets of surveys to the controller on the drilling rig with an electromagnetic (EM) transmitter. The method may include transmitting survey data corresponding to the first and second sets of surveys to the controller on the drilling rig with mud pulses.

A method of performing surveys during a drilling operation on a drilling rig is also provided, including: forming a plurality of stands by joining a plurality of tubulars; performing a drilling operation that advances a drill string through a subterranean formation to a downhole position, including taking a first set of downhole surveys at a first set of survey locations as stands of the plurality of stands are added to the drill string; removing only a portion of the stand from the drill string; and performing a tripping out operation to remove the drill string from the downhole position, including taking a second set of downhole surveys at a second set of survey locations as stands are removed from the drill string.

In some implementations, the method further includes performing a tripping in operation to reinsert the drill string to a downhole position, including taking a third set of downhole surveys at a third set of survey locations as stands are added to the drill string. The method may include removing a portion of a stand from the drill string before performing the tripping out operation and adding a portion of a stand to the drill string before performing the tripping in operation. The first set of survey locations may be offset from the second set of survey locations and the third set of survey locations are offset from the first set of survey locations. The method may further include transmitting survey data corresponding to the first, second, and third sets of downhole surveys to a controller on the drilling rig.

A method of performing surveys is also provided, including: performing a first set of surveys during a drilling operation, the first set of surveys being performed at first locations spaced apart by a first distance along a length of a wellbore; removing a tubular from the drill string; performing a second set of surveys during a tripping out operation, the second set of surveys being performed at second locations spaced apart by a second distance along the length of the wellbore; adding a tubular to the drill string; and performing a third set of surveys during a tripping in operation, the third set of surveys being performed at third locations being spaced apart by a third distance along the length of the wellbore.

In some implementations, the first locations are offset from the second locations and the third locations are offset from the first locations. The method may further include displaying the first, second, and third locations on a display device. The method may include transmitting survey data corresponding to the first, second, and third sets of surveys to a controller. The method may include transmitting survey data corresponding to the first, second, and third sets of surveys to the controller with an electromagnetic (EM) transmitter. The method may include transmitting survey data corresponding to the first, second, and third sets of surveys to the controller with mud pulses.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method of performing surveys during a drilling operation on a drilling rig, comprising:

forming a stand by joining a plurality of tubulars;

performing a drilling operation that advances a drill string to form a wellbore through a subterranean formation, including:

adding a plurality of stands to the drill string; and taking a downhole survey when a stand of the plurality of stands is added to the drill string to create a first set of surveys;

performing a tripping out operation to remove a portion of the drill string from the wellbore, including:

removing only a portion of a first stand from the drill string;

removing full-length stands from the drill string during the tripping out operation; and taking a downhole survey when each stand of the plurality of stands is removed from the drill string to create a second set of surveys, such that the second set of surveys is offset from the first set of surveys, wherein the first and second sets of surveys are offset from each other by a distance approximately equivalent to a length of the portion of the first stand removed during the tripping out operation.

2. The method of claim 1, wherein the step of removing the portion of the first stand comprises removing a tubular with a length in a range of about 30 to 36 feet.

3. The method of claim 1, wherein the step of removing the portion of the first stand comprises removing a tubular with a length in a range of about 40 to 45 feet.

4. The method of claim 1, further comprising performing the first and second set of surveys with an electromagnetic Measurement While Drilling (MWD) tool.

5. The method of claim 1, further comprising performing a tripping in operation to insert a portion of the drill string into the wellbore, including:

adding a portion of a second stand to the drill string;

adding full-length stands of the plurality of stands to the drill string during the tripping in operation; and taking a downhole survey when each stand of the plurality of stands is added to the drill string to create a third set of surveys, such that the first and second sets of surveys are offset from the third set of surveys.

6. The method of claim 5, further comprising displaying the first, second, and third sets of surveys on a display device.

7. The method of claim 1, further comprising transmitting survey data corresponding to the first and second sets of surveys to a controller on the drilling rig.

8. The method of claim 7, further comprising transmitting survey data corresponding to the first and second sets of surveys to the controller on the drilling rig with an electromagnetic (EM) transmitter.

9. The method of claim 7, further comprising transmitting survey data corresponding to the first and second sets of surveys to the controller on the drilling rig with mud pulses.

10. A method of performing surveys during a drilling operation on a drilling rig, comprising:

forming a plurality of stands by joining a plurality of tubulars;

performing a drilling operation that advances a drill string through a subterranean formation to a downhole position, including taking a first set of downhole surveys at a first set of survey locations as stands of the plurality of stands are added to the drill string;

removing only a portion of the stand from the drill string; and performing a tripping out operation to remove the drill string from the downhole position, including taking a second set of downhole surveys at a second set of survey locations as stands are removed from the drill string, wherein the first and second sets of surveys are offset from each other by a distance approximately equivalent to a length of the portion of the stand that was removed.

11. The method of claim 10, further comprising performing a tripping in operation to reinsert the drill string to a downhole position, including taking a third set of downhole surveys at a third set of survey locations as stands are added to the drill string.

12. The method of claim 11, further comprising removing the portion of a stand from the drill string before performing the tripping out operation and adding the portion of a stand to the drill string before performing the tripping in operation.

13. The method of claim 11, wherein the first set of survey locations are offset from the second set of survey locations and the third set of survey locations are offset from the first set of survey locations.

14. The method of claim 11, further comprising transmitting survey data corresponding to the first, second, and third sets of downhole surveys to a controller on the drilling rig.

15. A method of performing surveys, comprising:

performing a first set of surveys during a drilling operation advancing a drill string, the first set of surveys being performed at first locations spaced apart by a first distance along a length of a wellbore;

removing a tubular from the drill string;

performing a second set of surveys during a tripping out operation, the second set of surveys being performed at second locations spaced apart from the first set of surveys by a second distance along the length of the wellbore, the second distance being a different distance than the first distance;

adding a tubular to the drill string; and performing a third set of surveys during a tripping in operation, the third set of surveys being performed at third locations being spaced apart from the first set of surveys by a third distance along the length of the wellbore, the third distance being a different distance than the first and second distances.

16. The method of claim 15, wherein the first locations are offset from the second locations and the third locations are offset from the first locations.

17. The method of claim 15, further comprising displaying the first, second, and third locations on a display device.

18. The method of claim 15, further comprising transmitting survey data corresponding to the first, second, and third sets of surveys to a controller.

19. The method of claim 18, further comprising transmitting survey data corresponding to the first, second, and third sets of surveys to the controller with an electromagnetic (EM) transmitter.

20. The method of claim 18, further comprising transmitting survey data corresponding to the first, second, and third sets of surveys to the controller with mud pulses.

* * * * *